US008220289B2

(12) United States Patent
Yanagi et al.

(10) Patent No.: US 8,220,289 B2
(45) Date of Patent: Jul. 17, 2012

(54) REFRIGERATION APPARATUS WITH INTERNAL HEAT EXCHANGER FOR HEAT EXCHANGE

(75) Inventors: Hirofumi Yanagi, Moriguchi (JP); Kazuaki Mizukami, Moriguchi (JP); Setsu Hasegawa, Moriguchi (JP); Takashi Inoue, Moriguchi (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 539 days.

(21) Appl. No.: 12/326,420

(22) Filed: Dec. 2, 2008

(65) Prior Publication Data

US 2009/0139253 A1 Jun. 4, 2009

(30) Foreign Application Priority Data

Dec. 3, 2007 (JP) ..... 2007-312118

(51) Int. Cl.
*F25B 41/00* (2006.01)

(52) U.S. Cl. ..... 62/513; 62/515

(58) Field of Classification Search ..... 62/513, 62/515

See application file for complete search history.

(56) References Cited

U.S. PATENT DOCUMENTS

2006/0016214 A1* 1/2006 Gorbounov et al. ..... 62/513
2006/0260354 A1* 11/2006 Nakatani et al. ..... 62/513

FOREIGN PATENT DOCUMENTS

JP 7-18602 3/1995
JP 2005-226913 A1 8/2005
JP 2005-337577 12/2005
WO WO 2006/087004 8/2006

OTHER PUBLICATIONS

Japanese Office Action mailed Mar. 21, 2012, with English Translation in counterpart Japanese Application No. 2007-312218.

* cited by examiner

*Primary Examiner* — Cheryl J Tyler
*Assistant Examiner* — Jonathan Koagel
(74) *Attorney, Agent, or Firm* — Kratz, Quintos & Hanson, LLP

(57) ABSTRACT

Disclosed is a refrigeration apparatus capable of minimizing the pressure loss of a refrigerant circulated through an internal heat exchanger and capable of improving a cooling capability. A refrigeration apparatus in which a compressor, a radiator, an electronic expansion valve and an evaporator are successively annularly connected to one another to constitute a refrigerant circuit includes a refrigerator unit provided with the compressor and the radiator, and a cooling unit provided with the electronic expansion valve and the evaporator, the refrigerator unit is connected to one or a plurality of cooling units via a communication pipe to constitute the refrigerant cycle, an internal heat exchanger which performs heat exchange between a refrigerant discharged from the radiator and a refrigerant discharged from the evaporator is constituted of a double tube, and the internal heat exchanger is provided in the cooling unit.

3 Claims, 8 Drawing Sheets

FIG. 7

| | INNER TUBE | | | OUTER TUBE | | |
|---|---|---|---|---|---|---|
| | OUTER DIAMETER | THICKNESS | INTERNAL SECTIONAL AREA | OUTER DIAMETER | THICKNESS | INTERNAL SECTIONAL AREA |
| (1) | 9.52 | 1.2 | 39.8 | 19.05 | 1.5 | 131.1 |
| (2) | 7.94 | 1.0 | 27.7 | 15.88 | 1.2 | 93.2 |
| (3) | 6.35 | 0.8 | 17.7 | 12.7 | 1.0 | 58.2 |
| (4) | 4.76 | 0.8 | 7.8 | 9.52 | 0.8 | 31.5 |

REFRIGERATION APPARATUS WITH INTERNAL HEAT EXCHANGER FOR HEAT EXCHANGE

BACKGROUND OF THE INVENTION

The present invention relates to a refrigeration apparatus including an evaporator which constitutes an annular refrigerant circuit together with a cooling unit constituted of a compressor, a radiator, a pressure reduction unit and the like and which is provided on a cooling target side.

Heretofore, in this type of refrigeration apparatus, a refrigerant cycle is constituted by successively annularly connecting a compressor (e.g., a rotary compressor), a radiator, a pressure reducing unit (an expansion valve, a capillary tube, etc.), an evaporator and the like via pipes. A refrigerant gas sucked into the compressor is compressed in this compressor to form a high-temperature high-pressure refrigerant gas, and the gas is discharged to the radiator. The refrigerant gas releases heat in this radiator, then the pressure of the gas is reduced by pressure reducing means, and the gas is supplied to the evaporator. The refrigerant evaporates in the evaporator, and absorbs the heat from a surrounding area at this time to exert a cooling function.

Here, in recent years, to cope with a global environment problem, an apparatus has been developed in which carbon dioxide as a natural refrigerant is used as the refrigerant even in this type of refrigerant cycle without using conventional Freon and in which a supercritical refrigerant cycle operated with a supercritical pressure on a high pressure side is used.

In such a supercritical refrigerant cycle apparatus, to prevent a liquid refrigerant from returning to the compressor and being compressed, an accumulator is arranged on a low pressure side between an outlet side of the evaporator and a suction side of the compressor, the liquid refrigerant is accumulated in this accumulator and the gas only is sucked into the compressor. Moreover, the pressure reducing unit is adjusted so that the liquid refrigerant in the accumulator does not return to the compressor (e.g., see Japanese Patent Publication No. 7-18602 (Patent Document 1)).

However, when the accumulator is provided on the low pressure side of the refrigerant cycle, more refrigerant needs to be introduced. Moreover, to prevent the liquid refrigerant from being fed back as described above, the capacity of the accumulator needs to be enlarged, or the diaphragm adjustment of the pressure reducing unit needs to be performed. In consequence, the enlargement of an installation space or the lowering of the refrigeration capability in the evaporator is incurred.

To solve the problem, heretofore, an internal heat exchanger has been disposed in which heat exchange is performed between the refrigerant discharged from the radiator and the refrigerant discharged from the evaporator. FIG. 8 shows a perspective view of a conventional internal heat exchanger 100. This internal heat exchanger 100 includes a high pressure side flow path 101 through which the refrigerant from the radiator flows, and a low pressure side flow path 102 through which the refrigerant from the evaporator flows. The refrigerant from the radiator flows into the high pressure side flow path 101 from a refrigerant inlet 101A provided on the downside of the internal heat exchanger 100, and is discharged from a refrigerant outlet 101B provided on the upside of the internal heat exchanger 100. The refrigerant from the evaporator flows into the low pressure side flow path 102 from a refrigerant inlet 102A provided on the upside of the internal heat exchanger 100, and is discharged from a refrigerant outlet 1028 provided on the downside of the internal heat exchanger 100.

In consequence, when the heat exchange between the refrigerant from the radiator and the refrigerant from the evaporator is performed, the temperature of the refrigerant entering the pressure reducing unit is lowered to enlarge an entropy difference between the evaporators, whereby the refrigeration capability is improved (e.g., see Japanese Patent Application Laid-Open No. 2005-226913 (Patent Document 2)).

However, in the above refrigerant cycle apparatus disclosed in Patent Document 2, the internal heat exchanger is constituted of a double pipe to prevent the liquid refrigerant from being fed back with low cost. However, to realize predetermined heat exchange, a long double pipe needs to be constituted, and a refrigerant flow rate needs to be secured. However, such an internal heat exchanger is installed together with the compressor and the radiator in a refrigerator-side unit, and hence the installation space of the internal heat exchanger is restricted. To solve the problem, the diameter of the pipe is decreased, and the pipe is bent a plurality of times, when formed. In consequence, the heat exchanger can be installed in a small space while securing a necessary refrigerant flow rate (length).

However, since the pipe diameter decreases, a sectional area decreases with respect to the predetermined refrigerant flow rate, and the refrigerant flow rate is accelerated. In consequence, the pressure loss of the refrigerant circulated through the apparatus increases, which results in a problem that the performance of the refrigeration apparatus is lowered.

SUMMARY OF THE INVENTION

The present invention has been developed in order to solve a conventional technical problem, and an object thereof is to provide a refrigeration apparatus in which the pressure loss of a refrigerant circulated through an internal heat exchanger can be minimized to improve a cooling capability.

According to a first aspect of the invention, there is provided a refrigeration apparatus in which a compressor, a radiator, a pressure reducing unit and an evaporator are successively annularly connected to one another to constitute a refrigerant circuit, characterized by comprising: a refrigerator unit provided with at least the compressor and the radiator; and a cooling unit provided with at least the pressure reducing unit and the evaporator, the refrigerator unit being connected to one or a plurality of cooling units via a communication pipe to constitute the refrigerant cycle, an internal heat exchanger which performs heat exchange between a refrigerant discharged from the radiator and a refrigerant discharged from the evaporator being constituted of a double tube, the internal heat exchanger being provided in the cooling unit.

A refrigeration apparatus according to a second aspect of the invention is characterized in that in the above invention, the internal heat exchanger is provided in each cooling unit.

A refrigeration apparatus according to a third aspect of the invention is characterized in that in the above inventions, the internal heat exchanger is constituted integrally with the evaporator.

According to a fourth aspect of the invention, there is provided a refrigeration apparatus in which a compressor, a radiator, a pressure reducing unit and an evaporator are successively annularly connected to one another to constitute a refrigerant circuit, characterized by comprising: a refrigerator unit provided with at least the compressor and the radiator; and a cooling unit provided with at least the pressure reducing unit and the evaporator, the refrigerator unit being connected to one or a plurality of cooling units via a communication pipe to constitute the refrigerant cycle, an internal heat exchanger which performs heat exchange between a refrigerant discharged from the radiator and a refrigerant discharged from the evaporator being constituted of a double tube, the internal heat exchanger being configured to constitute at least a part of the communication pipe.

According to a fifth aspect of the invention, there is provided a refrigeration apparatus in which a compressor, a radiator, a pressure reducing unit and an evaporator are successively annularly connected to one another to constitute a refrigerant circuit, characterized by comprising: a refrigerator unit provided with at least the compressor and the radiator; a cooling unit provided with at least the pressure reducing unit and the evaporator; and an internal heat exchanger unit provided with a plurality of internal heat exchangers each constituted of a double tube and configured to perform heat exchange between a refrigerant discharged from the radiator and a refrigerant discharged from the evaporator, the refrigerator unit being connected to one or a plurality of cooling units via a communication pipe to constitute the refrigerant cycle, the internal heat exchanger unit being provided in the communication pipe, the number of the internal heat exchangers to be connected to the communication pipe is selectable.

A refrigeration apparatus according to a sixth aspect of the invention is characterized in that in the above inventions, the double tube constituting the internal heat exchanger is constituted of an inner tube and an outer tube, a high pressure side flow path through which the refrigerant from the radiator flows is constituted in the inner tube, and a low pressure side flow path through which the refrigerant from the evaporator flows is constituted between the inner tube and the outer tube.

A refrigeration apparatus according to a seventh aspect of the invention is characterized in that in the above inventions, carbon dioxide is used as the refrigerant.

According to the first aspect of the invention, the refrigeration apparatus in which the compressor, the radiator, the pressure reducing unit and the evaporator are successively annularly connected to one another to constitute the refrigerant circuit includes the refrigerator unit provided with at least the compressor and the radiator, and the cooling unit provided with at least the pressure reducing unit and the evaporator. The refrigerator unit is connected to one or a plurality of cooling units via the communication pipe to constitute the refrigerant cycle, the internal heat exchanger which performs the heat exchange between the refrigerant discharged from the radiator and the refrigerant discharged from the evaporator is constituted of the double tube, and the internal heat exchanger is provided in the cooling unit. In consequence, the internal heat exchanger can be provided in the cooling unit in which a broader installation space can be secured as compared with the refrigerator unit, for example, a showcase or the like.

Therefore, the internal heat exchanger capable of securing a predetermined heat exchange amount can be constituted of the double tube capable of appropriately securing the sectional area of a refrigerant flow path with respect to a refrigerant flow rate, and the flow rate of the refrigerant in the refrigerant flow path can be set to an appropriate flow rate. In consequence, the pressure loss of the refrigerant can be decreased.

Consequently, the heat exchange between the refrigerant from the radiator and the refrigerant from the evaporator can appropriately be performed, and the temperature of the refrigerant flowing from the radiator into the pressure reducing unit can efficiently be lowered to enlarge an entropy difference between the evaporators, thereby improving a refrigeration capability. In consequence, the compressor can be prevented from being damaged by liquid compression, without providing any accumulator.

Moreover, since the broad installation space is secured, the double tube having a necessary tube length can be constituted by the minimum number of bending times.

According to the second aspect of the invention, in the above invention, the internal heat exchanger is provided in each cooling unit. Therefore, in each cooling unit, the heat exchange between the refrigerant flowing into the pressure reducing unit and the refrigerant discharged from the evaporator can be performed in each internal heat exchanger provided in each cooling unit.

Therefore, in a case where a plurality of cooling units are provided, as compared with a case where the internal heat exchanger which realizes the refrigerant flow rate necessary for securing the refrigeration capability in the evaporators of all the cooling units is provided in the refrigerator unit as in a conventional example, when the internal heat exchanger is provided in each cooling unit, the tube length of each internal heat exchanger can be shortened.

Moreover, since the appropriate sectional area of the refrigerant flow path with respect to the refrigerant flow rate can be secured in each internal heat exchanger, the pressure loss of the refrigerant circulated through the exchanger can be decreased, and a cooling performance can be improved.

According to the third aspect of the invention, in the above inventions, the internal heat exchanger is constituted integrally with the evaporator, so that an operation in an installation site can be simplified. Moreover, when the leakage of the refrigerant is inspected, the evaporator and the internal heat exchanger do not have to be separately inspected, and an inspecting operation can be simplified.

According to the fourth aspect of the invention, the refrigeration apparatus in which the compressor, the radiator, the pressure reducing unit and the evaporator are successively annularly connected to one another to constitute the refrigerant circuit includes the refrigerator unit provided with at least the compressor and the radiator, and the cooling unit provided with at least the pressure reducing unit and the evaporator. The refrigerator unit is connected to one or a plurality of cooling units via the communication pipe to constitute the refrigerant cycle, the internal heat exchanger which performs the heat exchange between the refrigerant discharged from the radiator and the refrigerant discharged from the evaporator is constituted of the double tube, and the internal heat exchanger constitutes at least a part of the communication pipe. Therefore, in each internal heat exchanger of the internal heat exchanger unit, the heat exchange can be performed between the refrigerants in accordance with the number of the cooling units connected to the refrigerator unit via pipes and the flow rate corresponding to a thermal load due to a use environment such as a set temperature.

In particular, since the internal heat exchanger unit is provided in the communication pipe connecting the refrigerator unit to each cooling unit, the internal heat exchanger can be provided without being restricted by the installation space of the refrigerator unit or in a showcase or the like. Therefore, the internal heat exchanger capable of securing a predetermined heat exchange amount can be constituted of the double tube capable of appropriately securing the sectional area of the refrigerant flow path with respect to the refrigerant flow rate, and the flow rate of the refrigerant in the refrigerant flow path can be set to the appropriate flow rate. In consequence, the pressure loss of the refrigerant can be decreased.

Therefore, the temperature of the refrigerant flowing from the radiator into the pressure reducing unit can efficiently be lowered to enlarge the entropy difference between the evaporators, thereby improving the refrigeration capability. Moreover, the compressor can be prevented from being damaged by the liquid compression, without providing any accumulator.

According to the fifth aspect of the invention, the refrigeration apparatus in which the compressor, the radiator, the pressure reducing unit and the evaporator are successively annularly connected to one another to constitute the refrigerant circuit includes the refrigerator unit provided with at least the compressor and the radiator, the cooling unit provided with at least the pressure reducing unit and the evaporator, and the internal heat exchanger unit provided with the plurality of internal heat exchangers each constituted of the double tube and configured to perform the heat exchange between the refrigerant discharged from the radiator and the refrigerant discharged from the evaporator. The refrigerator unit is connected to one or a plurality of cooling units via the communication pipe to constitute the refrigerant cycle, the internal heat exchanger unit is provided in the communication pipe, and the number of the internal heat exchangers to be connected to the communication pipe is selectable. Therefore, the number of the internal heat exchangers of the internal heat exchanger unit to be connected to the communication pipe can be changed in accordance with the number of the cooling units connected to the refrigerator unit via the pipes, and the thermal load due to a use environment such as the set temperature.

In consequence, the heat exchange between the refrigerants having the flow rate corresponding to the number of the cooling units to be connected can be performed in each internal heat exchanger of the internal heat exchanger unit. Therefore, while decreasing the pressure loss of the refrigerant circulated through the internal heat exchanger, the heat exchange between the refrigerant discharged from the radiator and the refrigerant discharged from the evaporator can be performed. The temperature of the refrigerant flowing from the radiator into the pressure reducing unit can efficiently be lowered to enlarge the entropy difference between the evaporators, thereby improving the refrigeration capability.

Consequently, the compressor can be prevented from being damaged by the liquid compression, without providing any accumulator.

According to the sixth aspect of the invention, in the above inventions, the double tube constituting the internal heat exchanger is constituted of the inner tube and the outer tube, the high pressure side flow path through which the refrigerant from the radiator flows is constituted in the inner tube, and the low pressure side flow path through which the refrigerant from the evaporator flows is constituted between the inner tube and the outer tube. Therefore, the heat exchange between the refrigerant in the high pressure side flow path and the refrigerant in the low pressure side flow path can efficiently be performed.

According to the seventh aspect of the invention, in the above inventions, carbon dioxide is used as the refrigerant. In consequence, the operation is performed with a supercritical pressure on a high pressure side. However, when the above inventions are applied, it is possible to effectively prevent a disadvantage that the liquid refrigerant is returned to the compressor and compressed in the compressor.

Moreover, carbon dioxide for use as the refrigerant has incombustibility and corrosion resistance, and does not collapse ozone. The global warming coefficient of carbon dioxide is about 1/1000 or less of that of a Freon-based refrigerant. Therefore, the refrigeration apparatus suitable for the environment, that is, an apparatus capable of realizing non-Freon can be provided. Furthermore, carbon dioxide is remarkably easily available as compared with another refrigerant, so that convenience is also improved.

BRIEF DESCRIPTION OF THE DRAWINGS

FIG. 7 is a diagram showing specifications of each tube constituting the internal heat exchanger.

DETAILED DESCRIPTION OF THE PREFERRED EMBODIMENTS

Embodiments of the present invention will hereinafter be described in detail with reference to the drawings.

Embodiment 1

Figure 1:
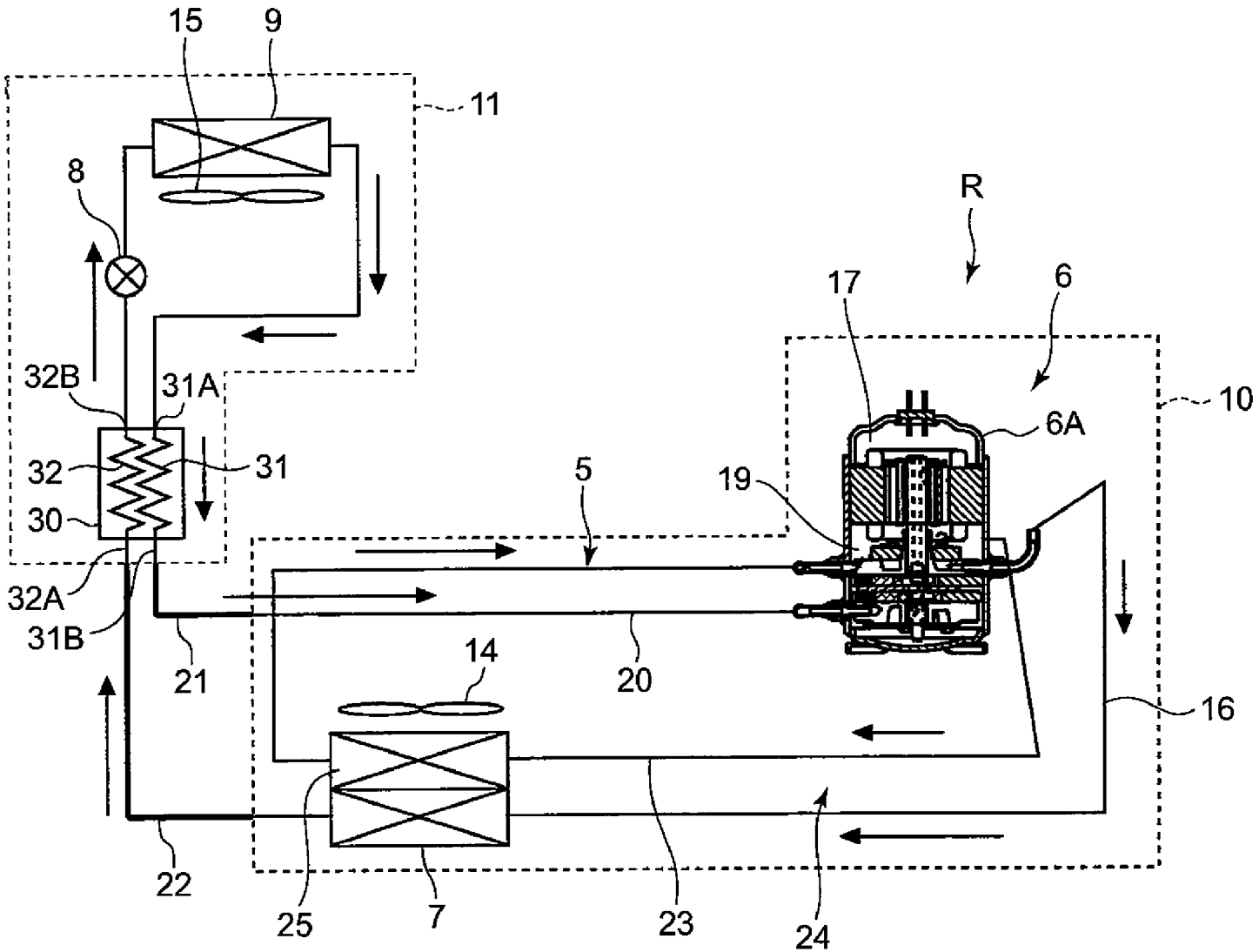
FIG. 1 is a refrigerant circuit diagram of a refrigeration apparatus of the present invention (Embodiment 1)
Figure 2:
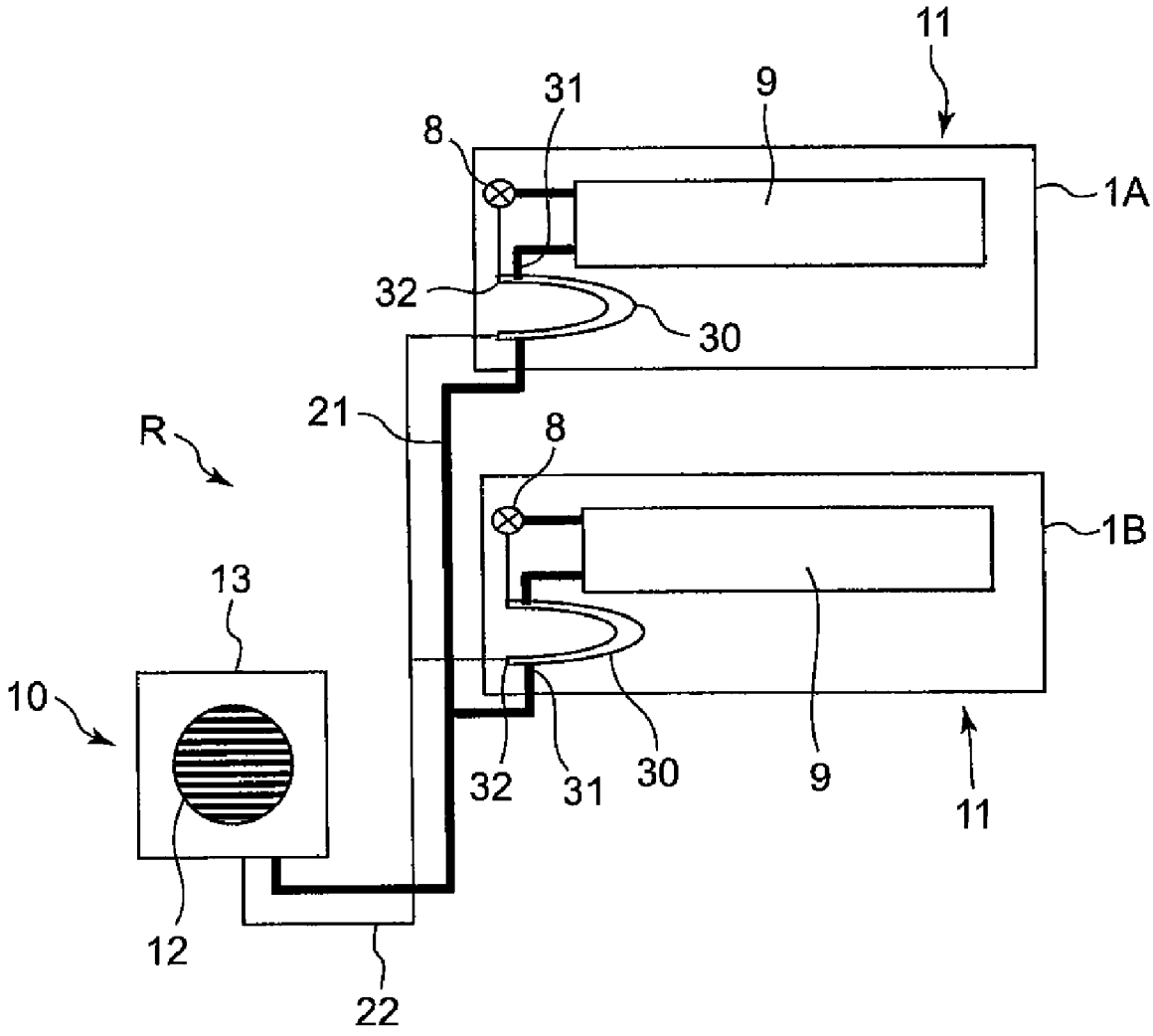
FIG. 2 is a schematic refrigerant circuit diagram to which the refrigeration apparatus of the present invention is applied (Embodiment 1)
Figure 3:
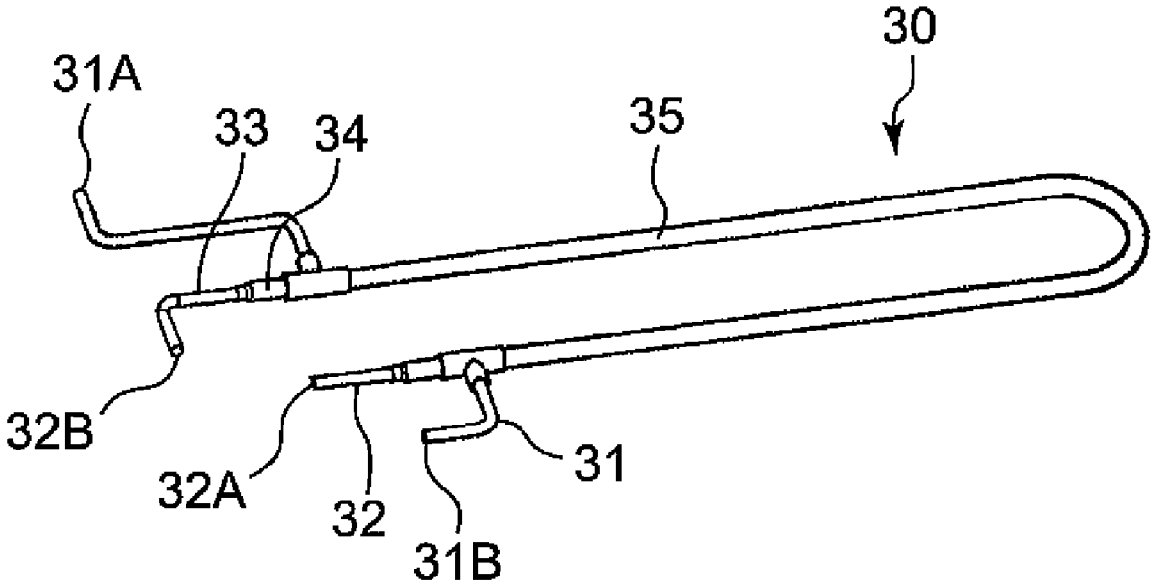
FIG. 3 is a perspective view of an internal heat exchanger.

First, a refrigeration apparatus R as Embodiment 1 will be described with reference to FIGS. 1 to 3. FIG. 1 shows a refrigerant circuit diagram of one embodiment of a refrigeration apparatus of the present invention, FIG. 2 shows a schematic refrigerant circuit diagram showing a state in which the apparatus is installed in a showcase, and FIG. 3 shows a perspective view of an internal heat exchanger, respectively.

The refrigeration apparatus R of the present embodiment is used for cooling a plurality of showcases 1 . . . installed in a store such as a supermarket or a convenience store. FIG. 2 shows the apparatus for cooling two showcases 1A, 1B.

In FIG. 1, reference numeral 5 is a refrigerant circuit of the refrigeration apparatus R, and the circuit is constituted by annularly connecting a compressor 6, a radiator 7, an electronic expansion valve 8 as a pressure reducing unit, an evaporator 9 and the like to one another.

The compressor 6, the radiator 7, and a blower 14 installed in the vicinity of the radiator 7 constitute a refrigerator unit 10, and the refrigerator unit is received in a refrigerator unit main body 13 provided with a grille 12, and installed mainly outside a store such as the supermarket.

The electronic expansion valve 8, the evaporator 9, a blower 15 for cooling arranged in the vicinity of the evaporator 9 or in a cooling duct where the evaporator 9 is installed, and an internal heat exchanger 30 described later in detail constitute a cooling unit 11. The cooling unit is installed on a showcases 1 side in the present embodiment. In the present embodiment, as the showcases 1, two showcases 1A, 1B are installed. Therefore, as shown in FIG. 2, each showcase is provided with the cooling unit 11 in which the electronic expansion valve 8, the evaporator 9, the blower 15 for cooling, the internal heat exchanger 30 and the like are arranged.

The refrigerator unit 10 is connected to the cooling units 11, 11 via a low pressure side communication pipe 21 and a high pressure side communication pipe 22 during installation.

A refrigerant discharge tube 16 of the compressor 6 constituting the refrigerator unit 10 is connected to an inlet of the radiator 7. Here, the compressor 6 of the embodiment is an internal intermediate pressure type two-stage compression system rotary compressor, and is constituted of an electromotive element 17 as a driving element in a sealed container 6A, and first and second rotary compression elements 18, 19 driven by the electromotive element 17.

In the drawing, reference numeral 20 is a refrigerant introduction tube for introducing a refrigerant into the first rotary compression element 18 of the compressor 6, and one end of this refrigerant introduction tube 20 communicates with a cylinder (not shown) of the first rotary compression element 18. The other end of this refrigerant introduction tube 20 is connected to an outlet 31B of a low pressure side flow path 31 of the internal heat exchanger 30 via the low pressure side communication pipe 21.

In the drawing, reference numeral 23 is a refrigerant introduction tube for introducing the refrigerant compressed by the first rotary compression element 18 into the second rotary compression element 19. This refrigerant introduction tube 23 is provided so as to extend through an external intermediate cooling circuit 24 of the compressor 6. In the intermediate cooling circuit 24, a heat exchanger 25 for cooling the refrigerant compressed by the first rotary compression element 18 is installed. The refrigerant compressed by the first rotary compression element 18 and having an intermediate pressure is cooled in the heat exchanger 25, and then sucked into the second rotary compression element 19. Moreover, this heat exchanger 25 is formed integrally with the radiator 7, and the blower 14 for the radiator is installed so as to feed air through the heat exchanger 25 and the radiator 7 and release heat from the refrigerant. It is to be noted that the refrigerant discharge tube 16 is a refrigerant pipe for discharged the refrigerant compressed by the second rotary compression element 19 to the radiator 7.

On the other hand, the radiator 7 on an outlet side is connected to the high pressure side communication pipe 22 for connecting the unit 10 to the units 11, and the other end of the communication pipe 22 is connected to an inlet 32A of a high pressure side flow path 32 of the internal heat exchanger 30.

Moreover, a pipe connected to an outlet 32B of the high pressure side flow path 32 of the internal heat exchanger 30 is connected to the evaporator 9 via the electronic expansion valve 8. Furthermore, the pipe exiting from the evaporator 9 is connected to an inlet 31A of the low pressure side flow path 31 of the internal heat exchanger 30.

It is to be noted that the refrigeration apparatus R of the present embodiment is used for cooling two (a plurality of) showcases 1A, 1B. Therefore, as shown in FIG. 2, the low pressure side communication pipe 21 and the high pressure side communication pipe 22 connecting the refrigerator unit 10 to the cooling units 11 are branched and connected to the cooling units 11 provided in the showcases 1A, 1B, respectively.

In the internal heat exchanger 30 provided in each cooling unit 11, heat exchange between the high pressure side refrigerant discharged from the radiator 7 and the low pressure side refrigerant discharged from the evaporator 9 is performed. As shown in FIG. 3, this internal heat exchanger 30 is constituted of a double tube including an inner tube 33 and an outer tube 34, and the outer periphery of the outer tube 34 is covered with an insulating material 35. Moreover, the high pressure side flow path 32 through which the refrigerant from the radiator 7 flows is formed in the inner tube 33, the low pressure side flow path 31 through which the refrigerant from the evaporator 9 flows is formed between the inner tube 33 and the outer tube 34, and the high pressure side flow path 32 and the low pressure side flow path 31 are arranged so as to perform the heat exchange.

Here, the internal heat exchanger 30 sufficiently lowers the temperature of the refrigerant from the radiator 7 to enlarge the entropy difference between the refrigerants flowing into the evaporator 9 through the electronic expansion valve 8, thereby securing a predetermined refrigeration capability. Moreover, the liquid refrigerant from the evaporator 9 is sufficiently evaporated to suck an only gas refrigerant by the compressor 6. In this case, the heat exchange between the refrigerant from the radiator 7 (the refrigerant in the high pressure side flow path 32) and the refrigerant from the evaporator 9 (the refrigerant in the low pressure side flow path 31) needs to be sufficiently performed.

When the sufficient heat exchange is performed, to secure the flow rate of the refrigerant circulated through the high pressure side flow path 32 and the low pressure side flow path 31 of the internal heat exchanger 30, each flow path needs to secure a predetermined sectional area in accordance with a thermal load in each cooling unit 11 (in this case, the thermal load varies in accordance with the in-chamber capacity of the showcase 1A or 1B, or a use environment such as a set temperature or an outside air temperature). FIG. 7 shows the outer diameters and the thicknesses of the inner tube 33 and the outer tube 34 constituting the internal heat exchanger 30, and the resultant internal section areas.

An internal heat exchanger (1) has the largest outer diameter and thickness of each tube among four internal heat exchangers illustrated herein, and hence large sectional areas of the flow paths are obtained. However, a tube length of about 3 mm is necessary so that the internal heat exchanger secures a predetermined refrigeration capability in the evaporator 9 of the cooling unit 11 arranged in each of, for example, three showcases. When the internal heat exchanger is provided in the refrigerator unit 10 as in a conventional example, it is difficult to bend the tube owing to a large tube diameter when forming the exchanger.

On the other hand, in an internal heat exchanger (2) or (3), as compared with the internal heat exchanger (1), each tube has a small outer diameter and a small thickness, and each resultant sectional area of the flow path is also small. However, when the internal heat exchanger (2) or (3) is provided as the internal heat exchanger 30 with respect to the cooling unit 11 arranged in each of the plurality of (two in the present embodiment) showcases 1A, 1B, the heat exchange between the high pressure side refrigerant and the low pressure side refrigerant can sufficiently be performed even with a tube length of about 1 m.

Therefore, the tube length can be shortened to miniaturize the internal heat exchanger 30. Even when the double tube constituting the internal heat exchanger is bent as much as the minimum number of bending times, that is, even when the double tube is bent once as shown in FIG. 3 in the present embodiment, the internal heat exchanger can be arranged together with the evaporator 9 in the cooling duct of the showcase having a comparatively broad installation space. Moreover, even with the sectional area of the refrigerant flow path in the internal heat exchanger (2) or (3), a necessary refrigerant flow rate (a heat exchange amount) may be an amount necessary for each cooling unit 11. Therefore, each internal heat exchanger does not have to secure the refrigerant flow rate required for all of the plurality of cooling units 11.

Even with the above sectional area, the refrigerant flow rate in the refrigerant flow path can be lowered, and an appropriate flow rate can be obtained, so that a pressure loss can be minimized. In consequence, while suppressing disadvantages that the flow rate is excessively retarded and that oil in the refrigerant does not easily return, the improvement of a cooling capability can be realized.

It is to be noted that an internal heat exchanger (4) in FIG. 7 has a small sectional area of the flow path as compared with the internal heat exchangers (2) and (3). Therefore, the internal heat exchanger is preferably used in the cooling unit having a small thermal load (a case where the set temperature is high or a cooling target space is small or the like) as compared with a case where the internal heat exchanger (2) or (3) is used.

Moreover, the internal heat exchanger 30 of the present embodiment constitutes the cooling unit 11 provided on the showcase 1 side together with the evaporator 9 as described, and the internal heat exchanger 30 is positioned by the side of the evaporator 9 and constituted integrally with the evaporator 9.

In consequence, an operation in an installation site can be simplified. Moreover, when the leakage of the refrigerant is inspected, the evaporator 9 and the internal heat exchanger 30 do not have to be separately inspected, and an inspecting operation can be simplified.

It is to be noted that in the internal heat exchanger 30 having the above-mentioned constitution, the inlet 32A is formed on the downside, and the outlet 32B is formed on the upside so that the refrigerant is fed through the high pressure side flow path 32 from the downside to the upside. That is, the high pressure side refrigerant from the radiator 7 enters the high pressure side flow path from the lower inlet 32A, and is discharged from the high pressure side flow path 32 via the upper outlet 32B.

On the other hand, the inlet 31A is formed in an upper end, and the outlet 32B is formed in a lower end so as to circulate the refrigerant through the low pressure side flow path 31 from the upside to the downside. That is, the low pressure side refrigerant from the evaporator 9 enters the low pressure side flow path 31 from the upper-end inlet 31A, and is discharged from the low pressure side flow path 31 via the lower-end outlet 32B.

In consequence, the refrigerant flowing through the high pressure side flow path 32 and the low pressure side flow path 31 constitutes a counter flow, so that a heat exchange capability in the internal heat exchanger 30 improves.

Moreover, in a case where the refrigerant is circulated through the high pressure side flow path 32 from the downside to the upside and the refrigerant is circulated through the low pressure side flow path 31 from the upside to the downside, when the high pressure is below a supercritical pressure, a surplus refrigerant can be accumulated in the high pressure side flow path 32 of the internal heat exchanger 30. In consequence, the surplus refrigerant flowing into a low pressure side at a time when the outside air has a low temperature can be decreased to avoid a disadvantage such as the breakage of the compressor 6 in advance.

Furthermore, as the refrigerant of the refrigeration apparatus R, eco-friendly carbon dioxide as a natural refrigerant in which combustibility, toxicity and the like are taken into consideration is used, and the refrigerant circuit 5 on the high pressure side has a supercritical pressure.

The operation of the refrigeration apparatus R of the present invention having the above constitution will be described. When the electromotive element 17 of the compressor 6 is started, the low-pressure refrigerant gas is sucked into the first rotary compression element 18 and compressed to have an intermediate pressure, and is discharged into the sealed container 6A. The refrigerant discharged into the sealed container 6A is once discharged from the sealed container 6A via the refrigerant introduction tube 23 to enter the intermediate cooling circuit 24 and flow through the heat exchanger 25. In the heat exchanger, the refrigerant receives air from the blower 14 for the radiator to release heat.

The refrigerant compressed by the first rotary compression element 18 is cooled by the heat exchanger 25 in this manner, and is then sucked into the second rotary compression element 19, so that the temperature of the refrigerant gas discharged from the second rotary compression element 19 of the compressor 6 can be lowered.

Afterward, the refrigerant is sucked into the second rotary compression element 19 and compressed to form a high-temperature high-pressure refrigerant gas, and the gas is discharged from the compressor 6 via the refrigerant discharge tube 16. At this time, the refrigerant is compressed to an appropriate supercritical pressure.

The refrigerant discharged from the refrigerant discharge tube 16 flows into the radiator 7, and receives the air from the blower 14 for the radiator to release the heat. Afterward, the refrigerant flows into the high pressure side flow path 32 of the internal heat exchanger 30 of the cooling unit 11 arranged in each of the showcases 1A, 1B via the high pressure side communication pipe 22. The refrigerant fed into the high pressure side flow path 32 performs heat exchange between this refrigerant and the refrigerant discharged from the evaporator 9 to flow through the low pressure side flow path 31 provided so as to perform the heat exchange between this flow path and the high pressure side flow path 32. In consequence, the heat of the refrigerant discharged from the radiator 7 and flowing through the high pressure side flow path 32 is taken by the refrigerant discharged from the evaporator 9 and flowing through the low pressure side flow path 31, to cool the refrigerant from the radiator.

Then, the high pressure side refrigerant cooled by the internal heat exchanger 30 and discharged from the outlet 32B reaches the electronic expansion valve 8. At this time, in the inlet of the electronic expansion valve 8, the refrigerant gas still has a gas state. When the pressure of the electronic expansion valve 8 lowers, the refrigerant is a two-phase gas/liquid mixture, and the refrigerant in this state flows into the evaporator 9. In the evaporator, the refrigerant evaporates, and absorbs the heat from the air to exert a cooling function.

At this time, in the internal heat exchanger 30 provided in each cooling unit 11, the refrigerant entering the electronic expansion valve 8 from the radiator 7 is cooled, so that an entropy difference between the evaporators arranged in the showcases 1A, 1B can be enlarged. Therefore, the refrigeration capability of the evaporator 9 in each of the showcases 1A, 1B can be improved.

Afterward, the refrigerant is discharged from the evaporator 9 to enter the low pressure side flow path 31 of the internal heat exchanger 30 via the inlet 31A. Here, the refrigerant evaporates to obtain a low temperature, and the refrigerant discharged from the evaporator 9 sometimes has a liquid mixed state instead of a complete gas state. However, when the refrigerant flows through the low pressure side flow path 31 of the internal heat exchanger 30 to perform the heat exchange between this refrigerant and the refrigerant flowing through the high pressure side flow path 32, the refrigerant is heated. At this time, the superheat degree of the refrigerant is secured to obtain the complete gas state.

In consequence, it is possible to avoid in advance a disadvantage that the liquid refrigerant is sucked into the compressor 6 to break the compressor 6 and the like.

It is to be noted that the refrigerant heated in the internal heat exchanger 30 repeats a cycle of being sucked into the first rotary compression element 18 of the compressor 6 through the low pressure side communication pipe 21 and the refrigerant introduction tube 20.

As described above, in the present embodiment, the feeding of the liquid back to the compressor 6 can be avoided. Moreover, the internal heat exchanger 30 capable of realizing the improvement of the refrigeration capability in the evaporator 9 is provided in each cooling unit 11, not on a refrigerator unit 10 side as in the conventional example, so that the broad installation space can be secured as compared with the refrigerator unit 10. In consequence, the internal heat exchanger 30 capable of securing a predetermined heat exchange amount can be constituted of a double tube capable of appropriately securing the sectional area of the refrigerant flow path with respect to the refrigerant flow rate, and the flow rate of the refrigerant in the refrigerant flow path can be set to an appropriate flow rate. Therefore, the pressure loss of the refrigerant can be decreased.

Therefore, the heat exchange between the refrigerant from the radiator 7 and the refrigerant from the evaporator 9 can appropriately be performed, and the temperature of the refrigerant flowing from the radiator 7 into the electronic expansion valve 8 can efficiently be lowered to enlarge an entropy difference between the evaporators 9, thereby improving the cooling capability.

In particular, according to the present embodiment, a showcase is provided in which a plurality of cooling units 11 are mounted with respect to the single refrigerator unit 10, and the internal heat exchanger 30 is provided in each cooling unit 11. In consequence/unlike a case where the internal heat exchanger which secures the heat exchange amount necessary for securing the refrigeration capability in the evaporators 9 of all the cooling units 11 is provided in the refrigerator unit 10 as in the conventional example, in a case where the internal heat exchanger 30 for realizing the necessary refrigerant flow rate is disposed in each cooling unit 11, each tube length of the internal heat exchanger 30 can be shortened.

Moreover, since the installation space of the internal heat exchanger 30 is large, the double tube having a necessary tube length can be constituted by the minimum number of the bending times.

Embodiment 2

Figure 4:
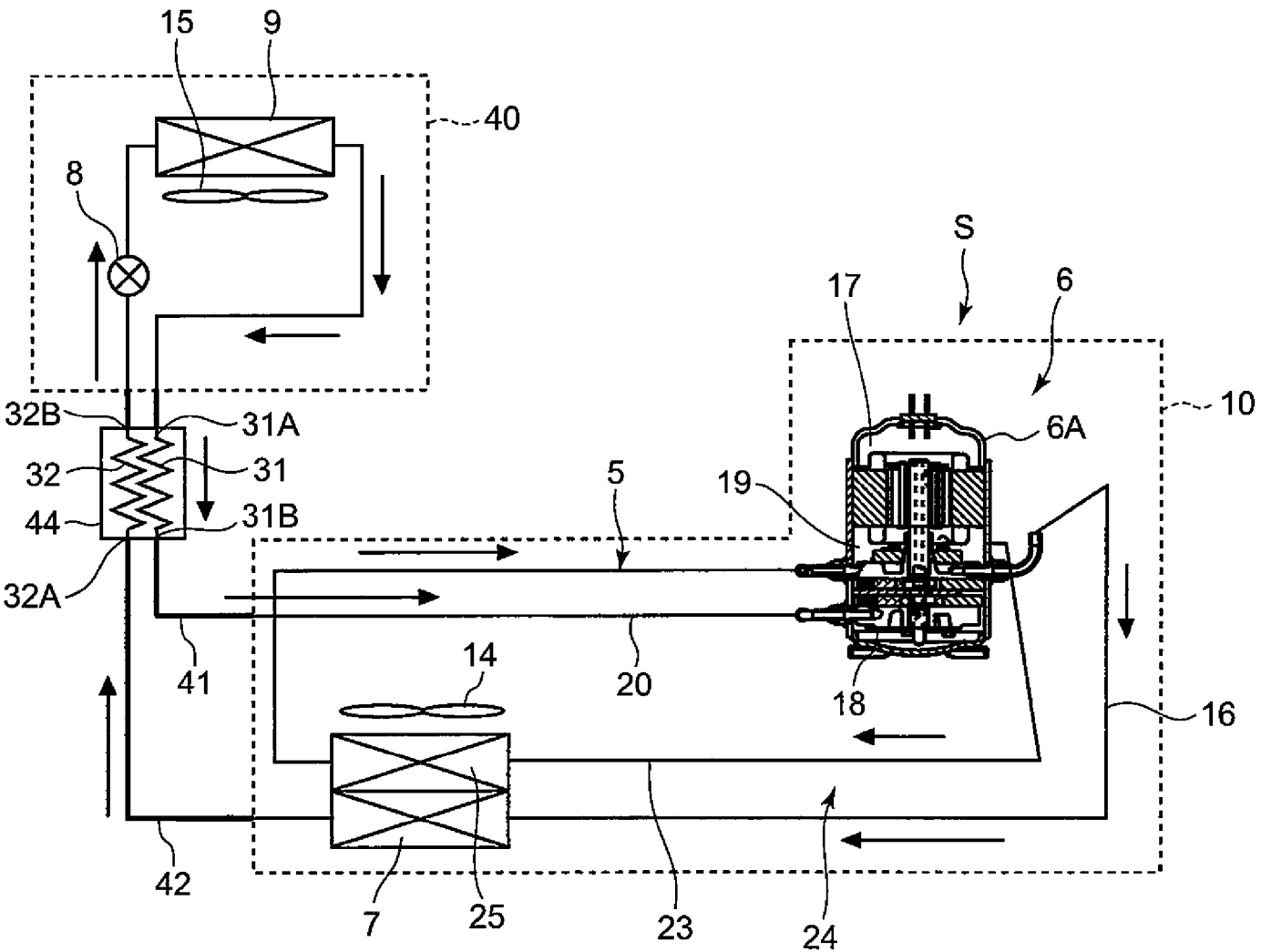
FIG. 4 is a refrigerant circuit diagram of the refrigeration apparatus of the present invention (Embodiment 2)
Figure 5:
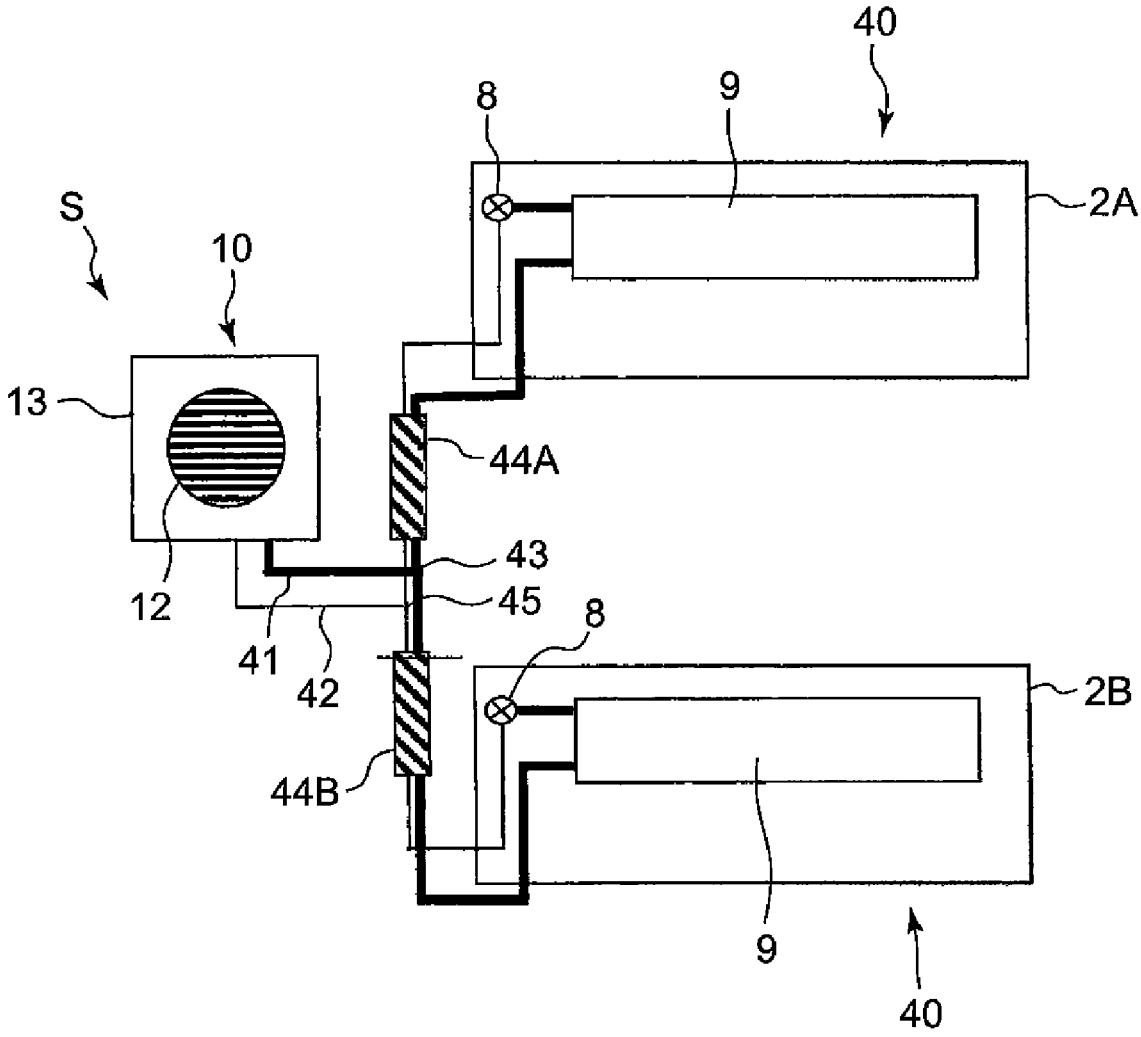
FIG. 5 is a schematic refrigerant circuit diagram to which the refrigeration apparatus of the present invention is applied (Embodiment 2)

Next, a refrigeration apparatus S as Embodiment 2 will be described with reference to FIGS. 4 and 5. FIG. 4 shows a refrigerant circuit diagram of the refrigeration apparatus S, and FIG. 5 shows a schematic refrigerant circuit diagram to which the refrigeration apparatus S is applied, respectively. It is to be noted that in the drawings, components denoted with the same reference numerals as those of FIGS. 1 to 3 have the same constitution and produce the same effects, and hence the description thereof is omitted.

The refrigeration apparatus S of Embodiment 2 is used for cooling a plurality of showcases 2 . . . installed in a store such as a supermarket or a convenience store in the same manner as in the refrigeration apparatus R of the above embodiment. FIG. 5 shows the apparatus for cooling two showcases 2A, 2B.

In FIG. 4, a compressor 6 and a radiator 7 constituting the refrigeration apparatus S, and a blower 14 installed in the vicinity of the radiator 7 constitute a refrigerator unit 10 in the same manner as in the above embodiment. An electronic expansion valve 8, an evaporator 9, and a blower 15 for cooling arranged in the vicinity of the evaporator 9 or in a cooling duct where the evaporator 9 is installed constitute a cooling unit 40, and are installed on a showcase 2 side in Embodiment 2. In the present embodiment, as the showcases 2, two showcases 2A, 2B are installed. Therefore, as shown in FIG. 5, each showcase is provided with the cooling unit 40 in which the electronic expansion valve 8, the evaporator 9, the blower 15 for cooling and the like are arranged.

The refrigerator unit 10 is connected to the cooling units 40, 40 via a low pressure side communication pipe 41 and a high pressure side communication pipe 42 during installation. In these communication pipes 41, 42, an internal heat exchanger 44 constituting a part of the communication pipe 41 or 42 is interposed.

That is, the other end of a refrigerant introduction tube 20 connected to the compressor 6 is connected to the low pressure side communication pipe 41 where a low pressure side flow path 31 of the internal heat exchanger 44 is interposed. Here, in Embodiment 2, the single refrigerator unit 10 is connected to two (a plurality of) cooling units 40, and the low pressure side communication pipe 41 has a constitution in which the refrigerant introduction tube 20 is connected to the evaporator 9 of each cooling unit 40 via a branch pipe 43. Moreover, the low pressure side flow path 31 of the internal heat exchanger 44 constituting a part of the low pressure side communication pipe 41 is arranged between the branch pipe 43 and each of the cooling units 40, 40 (i.e., each refrigerant upstream side of the branch pipe 43). It is to be noted that in FIG. 5, an internal heat exchanger on a showcase 2A side is denoted with reference numeral 44A, and an internal heat exchanger on a showcase 2B side is denoted with 44B.

On the other hand, the radiator 7 on an outlet side is connected to the high pressure side communication pipe 42 where a high pressure side flow path 32 of the internal heat exchanger 44 is interposed, and the other end of the communication pipe 42 is connected to the inlet side of the electronic expansion valve 8. Here, in the high pressure side communication pipe 42, a branch pipe 45 for distributing a high pressure side refrigerant from the radiator 7 to each cooling unit 40 is interposed. Therefore, the high pressure side flow path 32 of each internal heat exchanger 44 is arranged between the branch pipe 45 and each of the cooling units 40, 40 (i.e., on each refrigerant downstream side of the branch pipe 45) in the same manner as in the low pressure side flow path 31.

It is to be noted that the internal heat exchanger 44 has a constitution having such sectional area and tube length that a heat exchange amount corresponding to a thermal load in each cooling unit 40 can be secured substantially in the same manner as in the internal heat exchanger 30 of the above embodiment, and hence the detailed description thereof is omitted.

The operation of the refrigeration apparatus S of the present invention having the above constitution will be described. In the same manner as in the above embodiment, a high-temperature high-pressure refrigerant gas compressed by first and second rotary compression elements 18, 19 of the compressor 6 is discharged from the compressor 6 through a refrigerant discharge tube 16.

The refrigerant discharged from the refrigerant discharge tube 16 flows into the radiator 7, and releases heat in the radiator. Afterward, the refrigerant flows into the high pressure side flow paths 32, 32 of the internal heat exchangers 44A, 44B constituting the high pressure side communication pipe 42 through the branch pipe 45. The refrigerant entering the high pressure side flow path 32 performs heat exchange between this refrigerant and the refrigerant discharged from the evaporator 9 and flowing through the low pressure side flow path 31 arranged so as to perform heat exchange between this flow path and the high pressure side flow path 32. In consequence, the heat of the refrigerant discharged from the radiator 7 and flowing through the high pressure side flow path 32 is taken by the refrigerant discharged from the evaporator 9 and flowing through the low pressure side flow path 31, to cool the refrigerant from the radiator.

Then, the high pressure side refrigerant cooled by the internal heat exchangers 44A, 44B and discharged from an outlet 32B reaches the electronic expansion valve 8 constituting each cooling unit 40. When the pressure of the electronic expansion valve 8 lowers, the refrigerant is a two-phase gas/liquid mixture, and the refrigerant in this state flows into the evaporator 9. In the evaporator, the refrigerant evaporates, and absorbs the heat from the air to exert a cooling function.

Afterward, the refrigerant is discharged from the evaporator 9 to enter the low pressure side flow path 31 of the internal heat exchanger 44 constituting a part of the low pressure side communication pipe 41. In this flow path, the refrigerant evaporates to obtain a low temperature, and the refrigerant discharged from the evaporator 9 sometimes has a liquid mixed state instead of a complete gas state. However, when the refrigerant flows through the low pressure side flow path 31 of the internal heat exchanger 40 to perform the heat exchange between this refrigerant and the refrigerant flowing through the high pressure side flow path 32, the refrigerant is heated. At this time, the superheat degree of the refrigerant is secured to obtain the complete gas state.

Afterward, the refrigerants discharged from the low pressure side flow paths 31 of the internal heat exchangers 44A/44B combine with each other in the branch pipe 43. Afterward, it is possible to avoid in advance a disadvantage that the liquid refrigerant is sucked into the compressor 6 to break the compressor 6 and the like.

As described above, according to the refrigeration apparatus S of Embodiment 2, the communication pipes 41, 42 connecting the refrigerator unit 10 to the respective cooling units 40, 40 are provided with the internal heat exchangers 44 corresponding to the cooling units 40, 40, so that the internal heat exchanger 44 can be provided without being restricted by any installation space of the refrigerator unit 10 or in the showcase 2A, 2B or the like. In consequence, the internal heat exchangers 44, 44 capable of securing a predetermined heat exchange amount can be constituted of a double tube capable of appropriately securing the sectional area of the refrigerant flow path with respect to the refrigerant flow rate, and the flow rate of the refrigerant in the refrigerant flow path can be set to an appropriate flow rate. Therefore, the pressure loss of the refrigerant can be decreased.

Consequently, each internal heat exchanger 44 can secure a heat exchange amount between the refrigerant discharged from the radiator 7 constituting the refrigerator unit 10 and the refrigerant discharged from each evaporator 9 constituting each cooling unit 40, and the temperature of the refrigerant flowing from the radiator 7 into each electronic expansion valve 8 can efficiently be lowered to enlarge an entropy difference between the evaporators 9, thereby improving a refrigeration capability.

In consequence, the compressor 6 can be prevented from being damaged by liquid compression, without providing any accumulator.

It is to be noted that the embodiment has been described in which the single refrigerator unit 10 is connected to a plurality of cooling units 40 via the communication pipes 41, 42 to constitute a refrigerant circuit 5, but this is not restrictive. Even when the single refrigerator unit 10 is connected to the single cooling unit 40 via the communication pipes 41, 42 to constitute the refrigerant circuit 5 and a part of the communication pipes 41, 42 is constituted of the internal heat exchanger 44, a similar effect can be obtained.

Embodiment 3

Figure 6:
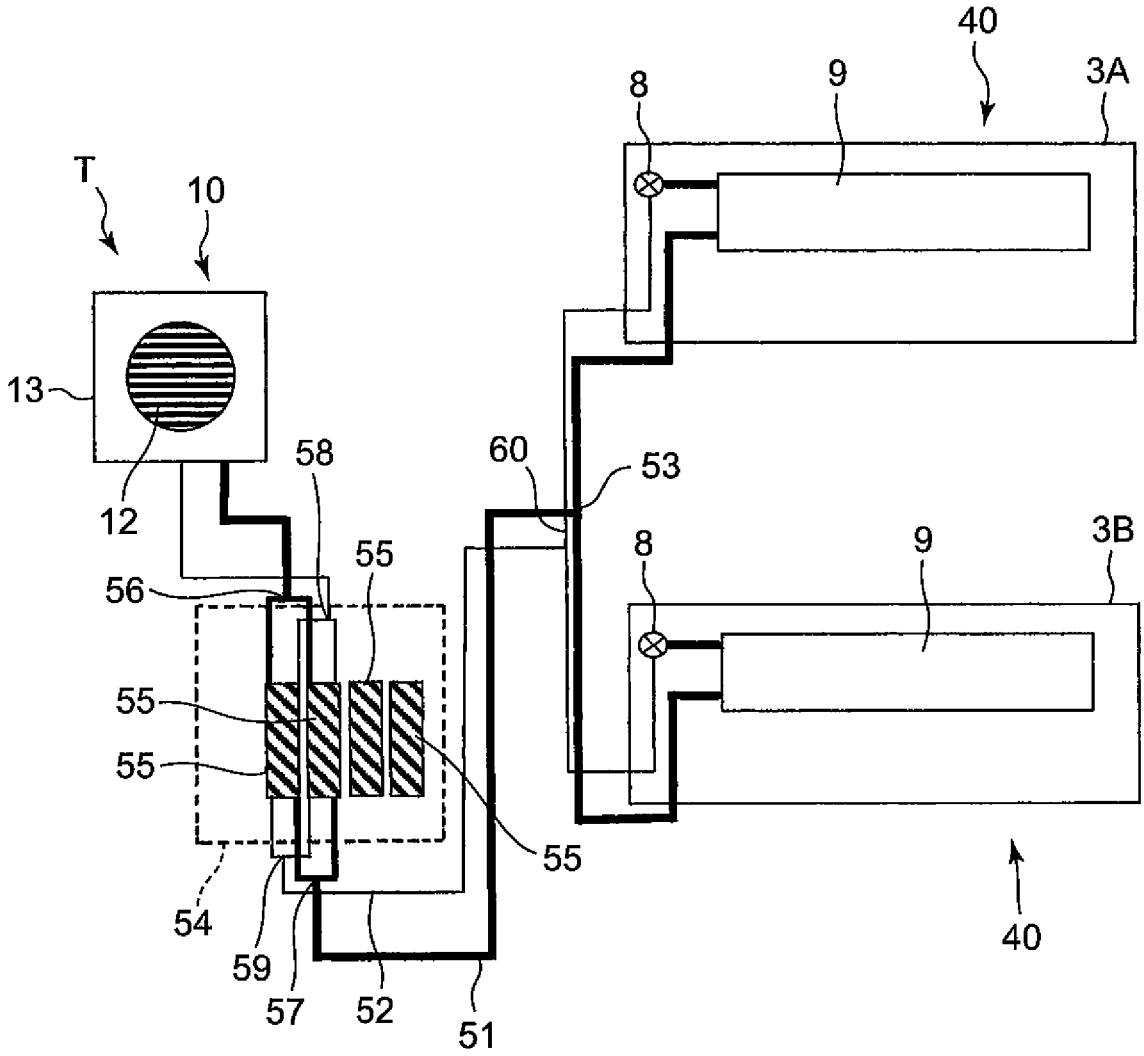
FIG. 6 is a schematic refrigerant circuit diagram to which the refrigeration apparatus of the present invention is applied (Embodiment 3)
Figure 8:
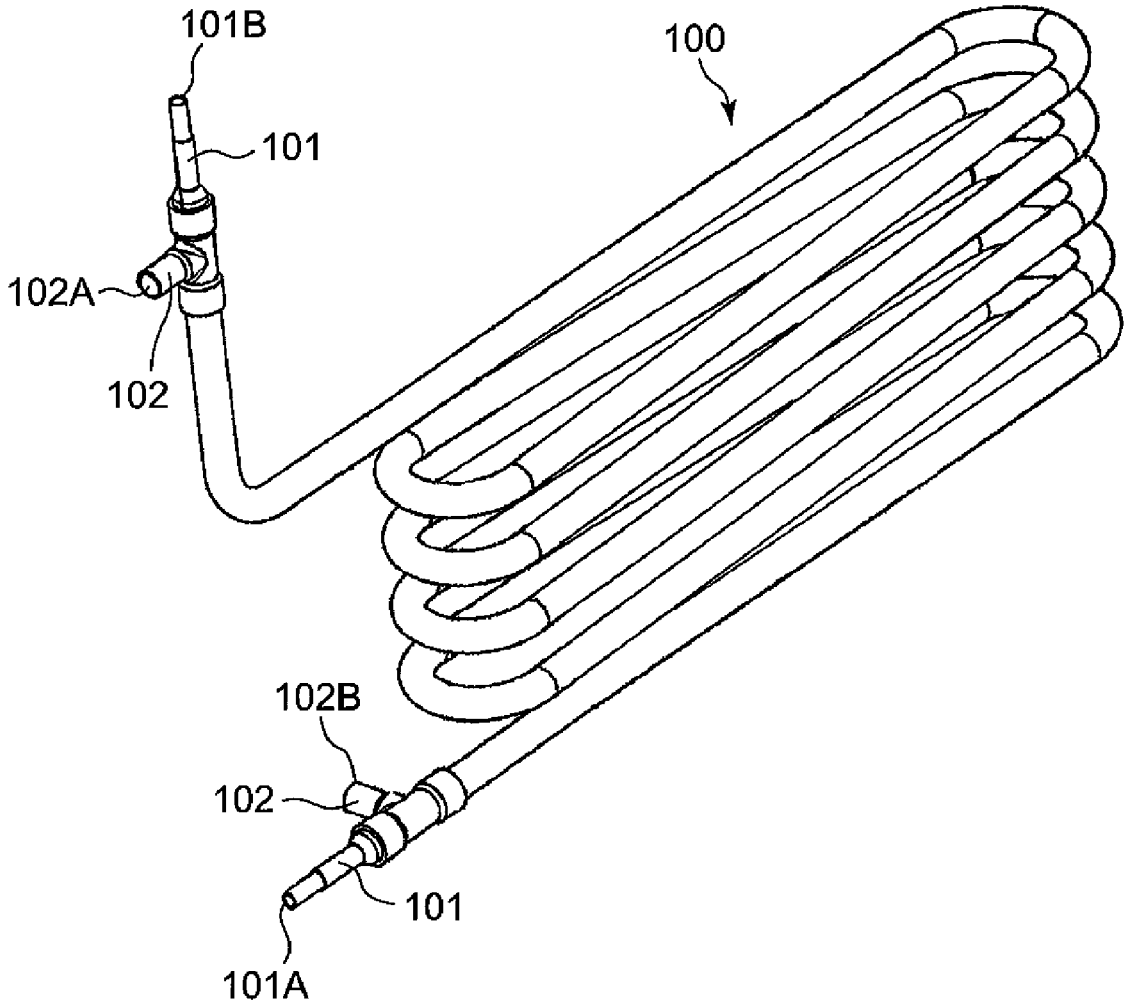
FIG. 8 is a perspective view of a conventional internal heat exchanger.

Next, a refrigeration apparatus T as Embodiment 3 will be described with reference to FIG. 6. FIG. 6 shows a schematic refrigerant circuit diagram to which the refrigeration apparatus T is applied. It is to be noted that in the drawing, components denoted with the same reference numerals as those of FIGS. 1 to 5 have the same constitution and produce the same effect.

The refrigeration apparatus T of Embodiment 3 is used for cooling a plurality of showcases 3 . . . installed in a store such as a supermarket or a convenience store in the same manner as in the refrigeration apparatuses R and S of the above embodiments. FIG. 6 shows the apparatus for cooling two showcases 3A, 3B.

It is to be noted that the refrigerant circuit diagram is substantially similar to FIG. 4 showing Embodiment 2 as described above, and even in the embodiment, as shown in FIG. 6, each showcase is provided with a cooling unit 40 in which an electronic expansion valve 8, an evaporator 9, a blower 15 for cooling and the like are arranged.

A refrigerator unit 10 having a constitution similar to the above embodiment is connected to the cooling units 40, 40 via a low pressure side communication pipe 51 and a high pressure side communication pipe 52 during installation. That is, the other end of a refrigerant introduction tube 20 connected to a compressor 6 is connected to the low pressure side communication pipe 51. Here, in Embodiment 3, the single refrigerator unit 10 is connected to two (a plurality of) cooling units 40, and the low pressure side communication pipe 51 has a constitution in which the refrigerant introduction tube 20 is connected to the evaporator 9 of each cooling unit 40 via a branch pipe 53.

Moreover, in the low pressure side communication pipe 51, an internal heat exchanger unit 54 constituting a part of the communication pipe 51 (in actual, a low pressure side flow path 31 of an internal heat exchanger 55 of the internal heat exchanger unit 54) is arranged between the refrigerator unit 10 and the branch pipe 53 (i.e., on the refrigerant downstream side of the branch pipe 53).

On the other hand, a radiator 7 on an outlet side is connected to the high pressure side communication pipe 52, and the other end of the communication pipe 52 is connected to the inlet side of the electronic expansion valve 8. Here, in the high pressure side communication pipe 52, a branch pipe 60 for distributing the high pressure side refrigerant from the radiator 7 to the cooling units 40 is interposed.

Moreover, in the high pressure side communication pipe 52, the internal heat exchanger unit 54 constituting a part of the communication pipe 52 (in actual, a high pressure side flow path 32 of the internal heat exchanger 55 of the internal heat exchanger unit 54) is arranged between the refrigerator unit 10 and the branch pipe 60 (i.e., on the refrigerant upstream side of the branch pipe 60) in the same manner as in the low pressure side communication pipe 51.

Here, the internal heat exchanger unit 54 includes a plurality of (four in the present embodiment) internal heat exchangers 55 each having a constitution similar to that of the internal heat exchanger 44 of Embodiment 2 described above. The low pressure side flow paths 31 provided in the internal heat exchangers 55 are connected in parallel via branch pipes 56, 57 so that the number of the connected flow paths (the number of the internal heat exchangers 55 for use) can be selected (changed). Similarly, the high pressure side flow paths 32 are connected in parallel via branch pipes 58, 59 so that the number of the connected flow paths (the number of the internal heat exchangers 55 for use) can be selected (changed).

In one example shown in FIG. 6, two internal heat exchangers 55 of the four internal heat exchangers 55 are connected so that the heat exchange can be performed, and the low pressure side flow paths 31, 31 of the two internal heat exchangers 55 are connected in parallel via the branch pipes 56, 57. Similarly, the high pressure side flow paths 32, 32 of the two internal heat exchangers 55 are connected in parallel via the branch pipes 58, 59.

In addition, when four cooling units 40 are connected to the refrigerator unit 10, the number of the internal heat exchangers 55 connected to the communication pipes 51, 52 is set to four. When one cooling unit 40 is connected to the refrigerator unit 10, the number of the internal heat exchangers 55 to be connected to the communication pipes 51, 52 is set to one. The number of the internal heat exchangers 55 to be connected to the communication pipes 51, 52 may be selected in accordance with the number of the cooling units 40 to be connected.

Moreover, even in a case where two cooling units 40 are connected to the refrigerator unit 10, when the set temperature of one of the cooling units 40 is a freezing temperature and the temperature of the other cooling unit 40 is a refrigeration temperature, the number of the internal heat exchangers 55 to be connected to the communication pipes 51, 52 may be set to three or the like.

Thus, the number of the internal heat exchangers 55 to be connected to the communication pipes 51, 52 can be selected (changed) in accordance with the number of the cooling units 40, 40 or a thermal load amount which fluctuates owing to the installation environment, the set temperature (the freezing temperature or the refrigeration temperature) of the cooling unit 40 or the like.

The operation of the refrigeration apparatus T of the present invention having the above constitution will be described. In the same manner as in the above embodiments, a high-temperature high-pressure refrigerant gas compressed by first and second rotary compression elements 18, 19 of the compressor 6 is discharged from the compressor 6 through a refrigerant discharge tube 16.

The refrigerant discharged from the refrigerant discharge tube 16 flows into the radiator 7, and releases heat in the radiator. Afterward, the refrigerant flows into the high pressure side flow path 32 of the internal heat exchanger 55 connected via the branch pipe 56 among the internal heat exchangers 55 constituting the high pressure side communication pipe 52 and constituting the internal heat exchanger unit 54. The refrigerant entering the high pressure side flow path 32 performs heat exchange between this refrigerant and the refrigerant discharged from the evaporator 9 and flowing through the low pressure side flow path 31 arranged so as to perform heat exchange between this flow path and the high pressure side flow path 32. In consequence, the heat of the refrigerant discharged from the radiator 7 and flowing through the high pressure side flow path 32 is taken by the refrigerant discharged from the evaporator 9 and flowing through the low pressure side flow path 31, to cool the refrigerant from the radiator.

Then, the high pressure side refrigerant cooled by the internal heat exchangers 55 reaches the electronic expansion valve 8 constituting each cooling unit 40 through the branch pipes 59, 60. When the pressure of the electronic expansion valve 8 lowers, the refrigerant is a two-phase gas/liquid mixture, and the refrigerant in this state flows into the evaporator 9. In the evaporator, the refrigerant evaporates, and absorbs the heat from the air to exert a cooling function.

Afterward, the refrigerant is discharged from the evaporator 9 to enter the low pressure side flow path 31 of the internal heat exchanger 55 connected to the branch pipe 57 among the internal heat exchangers 55 constituting the internal heat exchanger unit 54. In this flow path, the refrigerant evaporates to obtain a low temperature, and the refrigerant discharged from the evaporator 9 sometimes has a liquid mixed state instead of a complete gas state. However, when the refrigerant flows through the low pressure side flow path 31 of each internal heat exchanger 55 to perform the heat exchange between this refrigerant and the refrigerant flowing through the high pressure side flow path 32, the refrigerant is heated. At this time, the superheat degree of the refrigerant is secured to obtain the complete gas state.

Afterward, the refrigerants discharged from the low pressure side flow paths 31 of the internal heat exchangers 55 combine with each other in the branch pipe 56. Afterward, it is possible to avoid in advance a disadvantage that the liquid refrigerant is sucked into the compressor 6 to break the compressor 6.

As described above, according to the refrigeration apparatus T of Embodiment 3, the communication pipes 51, 52 connecting the refrigerator unit 10 to the respective cooling units 40, 40 are provided with the internal heat exchangers 54 in which the number of the internal heat exchangers 55 to be connected can be selected, so that the heat exchange between the refrigerants having the flow rate corresponding to the number of the cooling units 40 to be connected to the refrigerator unit 10 via the pipes or a thermal load amount such as the set temperature of a use environment can be performed in each internal heat exchanger 55 of the internal heat exchanger unit 54. Therefore, the sectional area of the refrigerant flow path with respect to the refrigerant flow rate in the internal heat exchanger unit 54 (in this case, the total sectional area of the flow paths of the connected internal heat exchangers) can appropriately be secured. In consequence, the flow rate of the refrigerant in the refrigerant flow paths of the whole internal heat exchanger unit 54 can be set to an appropriate flow rate, and the pressure loss of the refrigerant can be decreased.

In consequence, the temperature of the refrigerant flowing from the radiator 7 into the electronic expansion valve 8 can efficiently be lowered to enlarge an entropy difference between the evaporators 9, thereby improving a refrigeration capability. In consequence, the compressor can be prevented from being damaged by liquid compression, without providing any accumulator.

In particular, since the internal heat exchanger unit 54 is provided in the communication pipes 51, 52 connecting the refrigerator unit 10 to the respective cooling units 40, the internal heat exchanger 55 can be provided without being restricted by the installation space of the refrigerator unit 10 or in the showcase or the like.

It is to be noted that in the above embodiments, carbon dioxide is used as the refrigerant. In consequence, the operation is performed with the supercritical pressure on the high pressure side. However, when the above inventions are applied, a disadvantage that the liquid refrigerant returns into the compressor 6 and is compressed can effectively be prevented.

Moreover, carbon dioxide for use as the refrigerant has incombustibility and corrosion resistance, and does not collapse ozone. The global warming coefficient of carbon dioxide is about 1/1000 or less of that of a Freon-based refrigerant.

Therefore, the refrigeration apparatus suitable for the environment, that is, an apparatus capable of realizing non-Freon can be provided. Furthermore, carbon dioxide is remarkably easily available as compared with another refrigerant, so that convenience is also improved.

Furthermore, it has been described in the above embodiments that the electronic expansion valve 8 is used as the pressure reducing unit, but this is not restrictive, and a mechanical expansion valve, a capillary tube or the like may be used.

In addition, a case where the refrigeration apparatus of the present invention is applied to a plurality of showcases has been described in the above embodiments, but this is not restrictive, and the apparatus may be used for cooling a single showcase, or may be used in a cooling equipment such as an automatic vending machine, an air conditioner or a refrigerator.

What is claimed is:

1. A refrigeration apparatus in which a compressor, a radiator, a pressure reducing unit and an evaporator are successively annularly connected to one another to constitute a refrigerant circuit, the refrigeration apparatus comprising:

a refrigerator unit provided with at least a compressor and a radiator;

one or a plurality of cooling units, each provided with at least a pressure reducing unit and an evaporator;

an internal heat exchanger unit provided with a plurality of internal heat exchangers each constituted of a double tube and configured to perform heat exchange between a refrigerant discharged from the radiator and a refrigerant discharged from the evaporator, wherein the double tube constituting the internal heat exchanger is constituted of an inner tube and an outer tube, a high pressure side flow path through which the refrigerant from the radiator flows is constituted in the inner tube, and a low pressure side flow path through which the refrigerant from the evaporator flows is constituted between the inner tube and the outer tube;

branch pipes connecting in parallel the low pressure side flow paths of the internal heat exchangers; and branch pipes connecting in parallel the high pressure side flow paths of the internal heat exchangers;

the refrigerator unit being connected to each cooling unit via a communication pipe to constitute the refrigerant cycle, wherein the internal heat exchanger unit is provided in the communication pipe, and wherein the branch pipes are structured so that the number of low pressure side flow paths and high pressure side flow paths in the apparatus can be changed, such that the number of the internal heat exchangers to be connected to the communication pipe can be changed in accordance with the number of the cooling units connected to the refrigerator unit via the pipes, and the thermal load due to a use environment.

2. The refrigeration apparatus according to claim 1, wherein carbon dioxide is used as the refrigerant.

3. The refrigeration apparatus according to claim 1, wherein the use environment is the set temperature.

* * * * *